United States Patent [19]

McKerrow et al.

[11] 4,114,865

[45] Sep. 19, 1978

[54] SILENCER FOR USE ON TUYERE PUNCHERS

[75] Inventors: George C. McKerrow, Toronto; Albert Pelletier; Peter L. Fowler, both of Noranda, all of Canada

[73] Assignee: Noranda Mines Limited, Toronto, Canada

[21] Appl. No.: 813,528

[22] Filed: Jul. 7, 1977

[30] Foreign Application Priority Data

Mar. 10, 1977 [CA] Canada ..... 273691

[51] Int. Cl.[2] ..... F27B 7/36

[52] U.S. Cl. ..... 266/136; 266/269

[58] Field of Search ..... 266/47, 135, 136, 218, 266/265, 269, 271, 287

[56] References Cited

U.S. PATENT DOCUMENTS

| | | | |
|---|---|---|---|
| 2,425,792 | 8/1947 | Forbes | 266/136 |
| 3,314,671 | 4/1967 | Heino et al. | 266/271 |
| 3,328,016 | 6/1967 | Foard et al. | 266/136 |
| 4,019,725 | 4/1977 | Cote | 266/269 |

FOREIGN PATENT DOCUMENTS

| | | | |
|---|---|---|---|
| 993,368 | 7/1976 | Canada | 266/287 |

*Primary Examiner*—Gerald A. Dost

*Attorney, Agent, or Firm*—Fleit & Jacobson

[57] ABSTRACT

A silencer for use with a tuyere puncher is disclosed. The silencer comprises a chamber having a front face and a rear face provided with a central opening for passing of the punch bar operated by the puncher, a plurality of closure members located in the rear portion of the chamber and mounted for movement toward and away from the longitudinal axis of the chamber and including means for forcing the closure members against the periphery of the punch bar so as to form a seal between the closure members and the punch bar, and a seal secured to the front face of the chamber for engaging the tuyere to seal such a tuyere before penetration of the punch bar through the tuyere valve. The silencer is mounted on a mobile table which is supported by the puncher and operated in synchronism with the punch bar.

8 Claims, 8 Drawing Figures

SILENCER FOR USE ON TUYERE PUNCHERS

This invention relates to a silencer for use with tuyere punchers.

It is common practice in certain metallurgical processes to treat molten metal by blowing gas into the molten bath by means of submerged tuyeres. Accretions form at the end of the tuyere and such must be regularly removed. This is nowadays commonly done by means of tuyere punchers which automatically insert a punch bar through a ball or flapper type of valve giving access to the tuyere. When the punch bar is inserted through the ball or flapper type valve, gas escapes between the punch bar and the seat of the valve and causes a loss of gas creating a loud blast noise and possibly ejecting hot metal particles.

A gas seal and silencer has been disclosed by the applicant in U.S. application Ser. No. 598,806, now U.S. Pat. No. 4,019,725.

This silencer is designed for use on the tuyere body and, necessarily, requires the use of one such silencer per tuyere. Modern metallurgical vessels are provided with a large number of tuyeres and this requires the use of an equal number of silencers. The cost of manufacturing and maintaining such a large number of silencers could be greatly reduced if the silencers were mounted on the punchers themselves. One such silencer has been disclosed in Canadian Pat. No. 993,368 issued to Hatch Associates Ltd. on July 20th, 1976. This silencer is difficult to align with the axis of the tuyere due to the lifting action of the mechanism moving the silencer into engagement with the tuyere. The silencer also requires a special punch bar head and, for these reasons, has not found well spread use.

It is therefore the object of the present invention to provide a silencer for use with a tuyere puncher which overcomes the drawbacks of the existing silencers.

The silencer, in accordance with the invention, comprises a chamber having a front face and a rear face provided with a central opening for passage of a punch bar operated by the puncher, a plurality of closure members located in the rear portion of such chamber and mounted for movement toward and away from the longitudinal axis of the chamber and including means for forcing the closure members against the periphery of the punch bar so as to form a seal between the closure members and the punch bar, and a seal secured to the front face of the chamber for engaging the tuyere before penetration of the punch bar through the tuyere.

The chamber preferably consists of a front portion housing the heated portion of the punch bar when retracted from the tuyere and a rear portion housing the closure members which form a seal around the punch bar.

In a preferred embodiment of the invention, a mobile table is mounted on the puncher and supports the silencer chamber for movement into and out of engagement with the tuyere. The mobile table is preferably secured to the front end of two shafts slidably mounted one on each side of the puncher and each connected to the piston of an air or hydraulic cylinder, although the mobile table could be operated by only one shaft and a single cylinder. The silencer chamber is advantageously supported by a saddle which is mounted on the mobile table and adjustable vertically so as to accurately position the silencer with respect to the longitudinal axis of the tuyere. Furthermore, the puncher normally operates a plurality of punch bars connected to a common yoke operated by an air or hydraulic cylinder. Thus, the mobile table is normally arranged to support a number of silencers equal to the number of punch bars.

In a preferred embodiment of the invention, the cylinders operating the mobile table are synchronized for operation with the cylinder operating the punch bar yoke. Preferably, the movement of the mobile table towards the tuyere is synchronized with the movement of the punch bar, whereas the withdrawal of the mobile table is mechanically done by the punch bar yoke.

The invention will now be disclosed, by way of example, with reference to the accompanying drawings in which.

Figure 2:
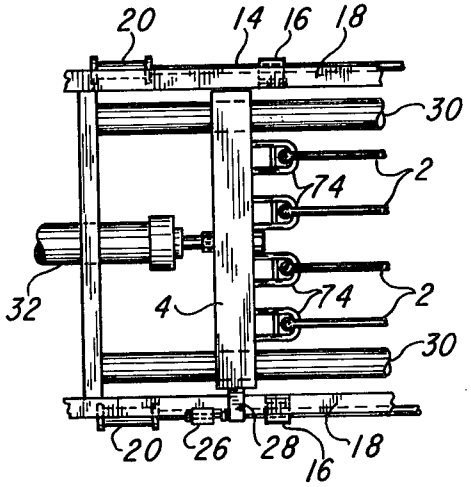
FIGS. 1, 2 and 3 illustrate side, top and front views respectively of the mechanism for operating and supporting the silencer in accordance with the invention, mounted on a tuyere puncher.
Figure 1:
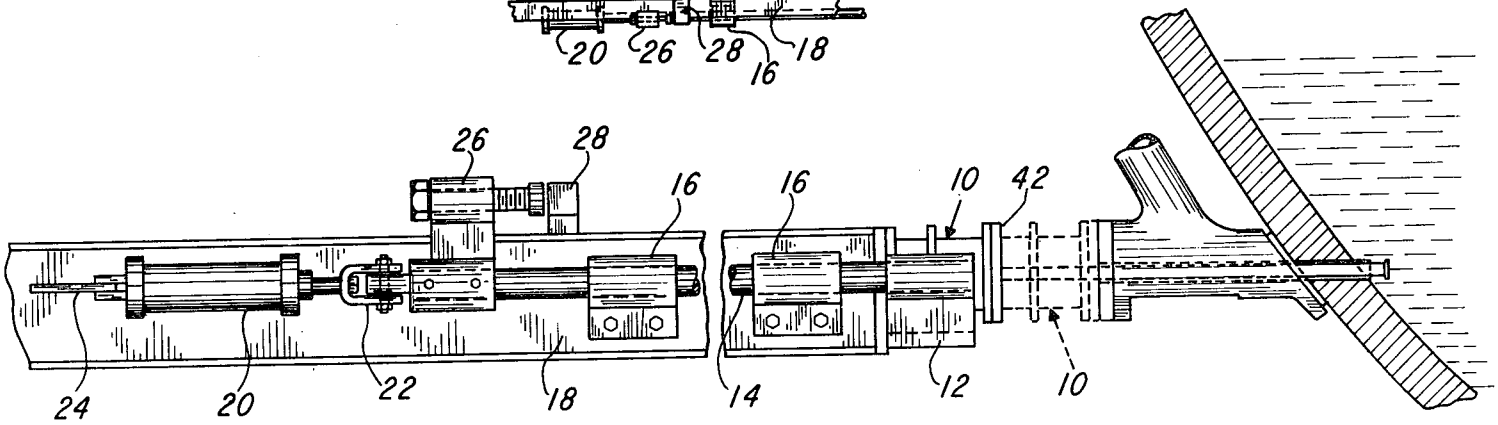
Figure 3:
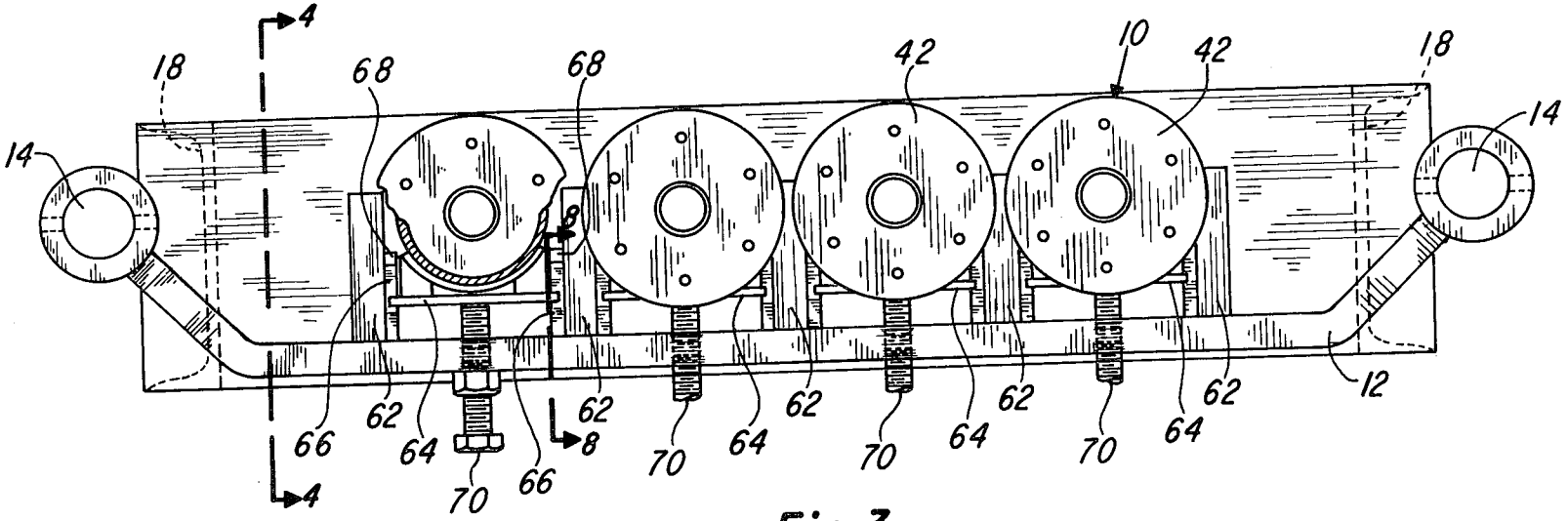

Referring to FIGS. 1, 2 and 3, there are shown portions of a tuyere puncher operating four punch bars 2 through a common yoke 4, each punch bar being equipped with a silencer 10. The silencers 10 are supported by a mobile table 12 which is secured to the front end of two shafts 14 slidably mounted in bearings 16 secured to the puncher side channels 18. The rear end of each shaft 14 is secured to the piston of an air or hydraulic cylinder 20 by means of shackles 22 for operation of the mobile table. The body of each cylinder 20 is secured to a flange 24 which is welded or otherwise secured to channel 18. A shaft retractor 26 is secured to the rear end of one shaft 14 and such retractor is engaged by a bar 28 which is secured to the punch bar yoke 4 during withdrawal of the punch bars as it will be more fully disclosed later on in the description. The punch bar yoke is slidably mounted on guides 30 and operated by main cylinder 32.

Referring now to FIGS. 4 to 7, there are shown the details of an embodiment of the silencer itself. Such embodiment comprises a chamber having a front portion housing the head of the punch bar 2 when retracted and consisting of an open cylinder 33 closed by two end plates 34 and 36 having openings therein for passage of the punch bar. A conical sleeve 38 is positioned within the chamber for centering the punch bar. A sleeve 40 is welded to front plate 36 for supporting a seal 42 made of heat resistant resilient, flexible material, such as rubber. Seal 42 is for sealing the tuyere ahead of the punch bar penetration into the tuyere and is secured to plate 36 by any suitable means such as rivets 44. The rear portion of the chamber holds a seal around the punch bar when inserted into the tuyere. As more clearly illustrated in FIGS. 6 and 7, such seal comprises four closure members in the form of jaws 46 located inside the housing 48 and pressed toward the longitudinal axis of the housing by springs 50 so as to maintain such jaws self-centered within the housing. The jaws 46 are preferably tapered from the outside toward the ends contacting the punch bar as indicated at 52 and the ends of the jaws contacting the punch bar are shaped so as to correspond to a segment of a circle in cross-section in order to match the periphery of the punch bar. In cases where the punch bar is not circular, it will be understood that the ends of the jaws will preferably be made to match the periphery of the punch bar. The ends of the jaws opposite to those contacting the punch bar have recesses 54 therein and the springs 50 are lodged in such recesses to be held in position. The sectorial angle of the jaws 46 is such that when in contact with the punch bar there is no space left between the jaws themselves so as to efficiently seal the rear end of the silencer chamber.

The jaws 46 are guided by end plates 56 and 34 which close the housing. The jaws and the end plates are normally made of hard metal or hardened, such as by case hardening, to prevent wear of the sliding surfaces. Wear washers may also be provided between the jaws and the end plates 56 and 34 to reduce maintenance cost as such wear washers may be readily replaced. To facilitate assembly of the rear seal of the silencer, plates 34 and 56 are provided with recesses 58 and housing 48 is positioned in such recesses and held in place by bolts 60 which protrude through plate 56 and are screwed into plate 34.

Figure 8:
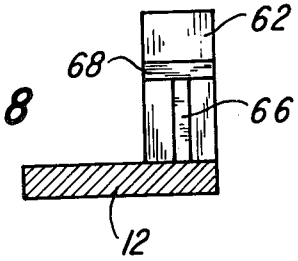
FIG. 8 illustrates a section view taken along lines 8—8 of FIG. 3.
Figure 5:
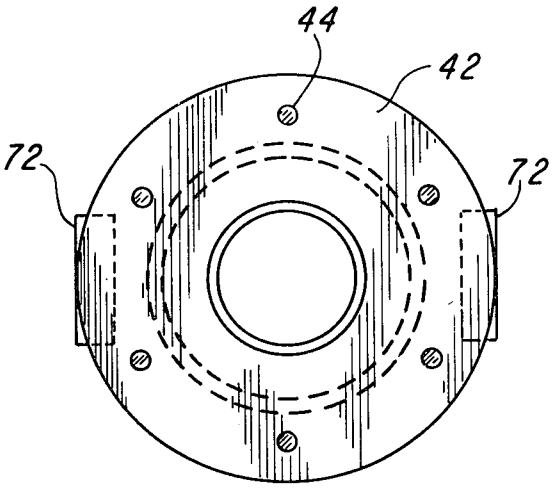
FIGS. 4 and 5 illustrate enlarged side and front views respectively of the silencer itself.
Figure 4:
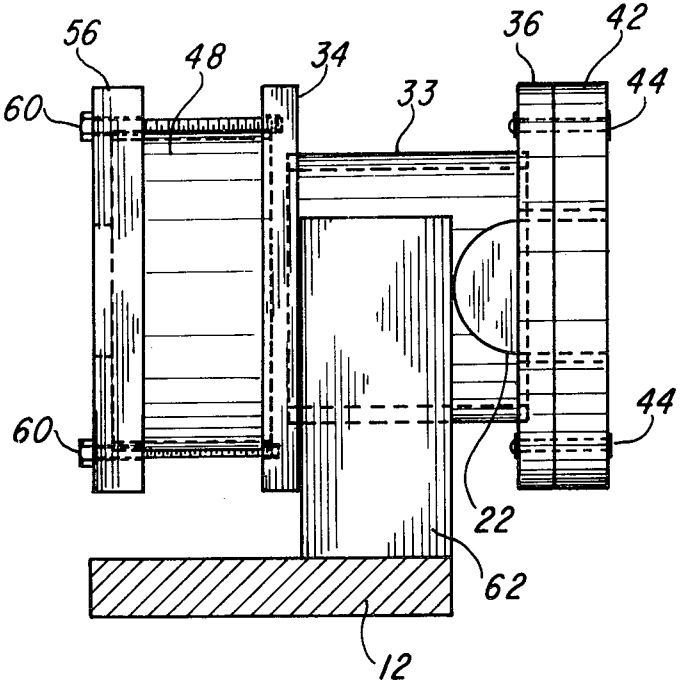

Referring now to FIGS. 3 and 4, regularly spaced bars 62 are welded or otherwise secured vertically on mobile table 12 and saddles 64 located between each pair of bars 62 for supporting the silencers. As shown in FIG. 8, the facing surfaces of the bars 62 are provided with vertical guide bars 66 and horizontal upper limit bars 68. Slots (not shown) are provided in the ends of the bottom plate of each saddle and such slots engage into the guide bars 66. Adjusting bolts 70 are threaded into the mobile table 12 for adjusting the vertical position of the saddles 64. The vertical position of the silencers may thus be accurately controlled by adjustment of bolts 70 so as to align the punch bars located in the silencers with the axis of the tuyere. As shown in FIGS. 3, 4 and 5, the upper end of bars 62 are designed to engage plate 34 on one side and block 72 secured to plate 36 on the other side for moving the silencers during operation of the mobile table.

In multi punch bar punching machines, such as the one disclosed in Canadian Pat. No. 727,540 issued Feb. 8th, 1966, the punch bars are all removably connected to the common yoke 4, such as by device 74 illustrated in FIG. 2, to allow fast punch bar change and also for easy disengagement from the puncher in case of roll out of the metallurgical vessel when the punch bars are inserted in the tuyeres. It will be also appreciated that the silencers in accordance with the invention conveniently sit loosely on top of the saddles to also allow fast punch bar change and permit easy disengagement in cas of roll out.

Figure 6:
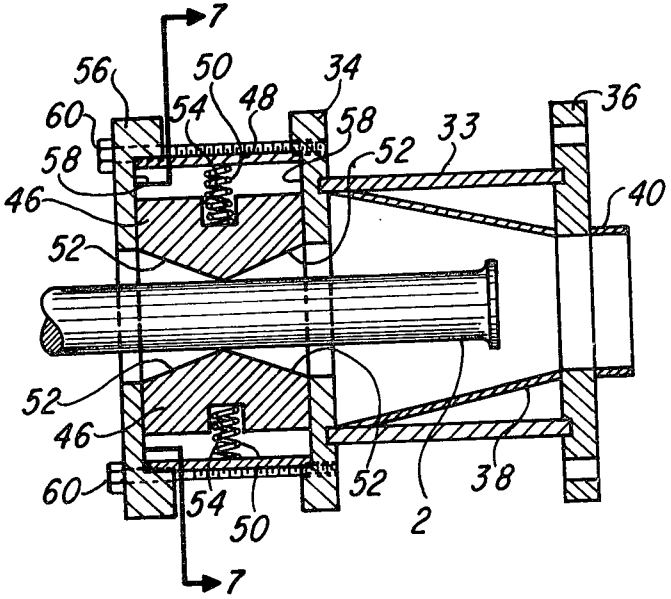
FIGS. 6 and 7 illustrate section views of the silencer of FIG. 4.
Figure 7:
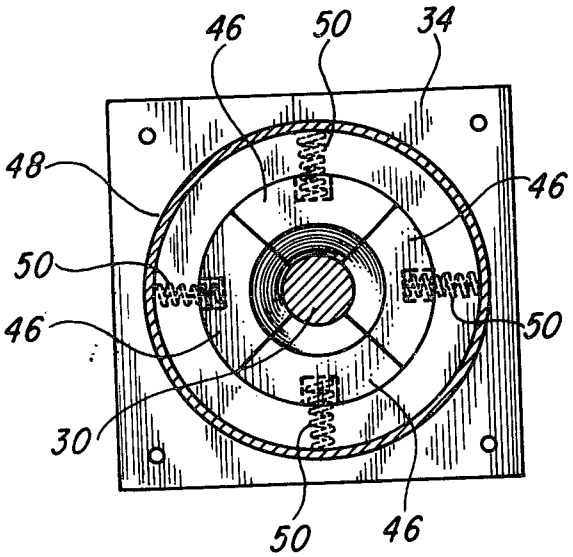

At rest, the punch bar remains located within the silencer closure jaws as shown in FIG. 6. Furthermore, the main cylinder 32 of the punch bar yoke and the cylinders 20 operating the mobile table 12 are preferably designed in such a way that the silencers travel at the same rate as the punch bars when operated in the forward direction, but the stroke of the main cylinder is larger than the stroke of the cylinders operating the mobile table. Thus, after operation of the above cylinders, the silencers and punch bars move together until the tuyere body is reached and sealed by the front seal 42 of the silencers. The punch bars then keep moving to penetrate the tuyere, as shown by the dotted lines in FIG. 1, and to clear the accretions in the tuyere. While the tuyere is being cleared, the silencer is held pressed against the tuyere body by the action exerted by the cylinders 20 on the mobile table 12. On the return stroke of the punch bar yoke, the head of the punch bars is extracted from the tuyere seal; then the bar 28 secured to the punch bar yoke engages retractor 26 and pulls the mobile table 12 and the silencers away from the tuyere body at the same rate as the punch bars, until the punch bar yoke comes to rest in the position shown in FIG. 1.

Although the invention has been disclosed with reference to a preferred embodiment thereof, it is to be understood that various modifications are envisaged within the scope of the following claims. For example, the number of silencers may vary and there may be only one silencer per puncher. The shape of the silencer chamber may also vary and it is also envisaged to make it in a single chamber instead of a two portion chamber as shown in the preferred embodiment of the invention. In addition, other means of operating the silencers in a straight forward motion are also contemplated.

What is claimed is:

1. A silencer for use with a tuyere puncher comprising:

(a) a chamber having a front face and a rear face provided with a central opening for passing of a punch bar operated by said puncher;

(b) a plurality of closure members adjacent the rear face of the chamber and mounted for movement toward and away from the longitudinal axis of the chamber and including means for forcing the closure member against the periphery of the punch bar so as to form a seal between the closure members and the punch bar;

(c) a seal secured to the front face of the chamber for engaging the tuyere to seal the tuyere before penetration of the punch bar through the tuyere;

(d) a mobile table slidably mounted on the puncher --for supporting said chamber; and (e) operating means mounted on the puncher for pushing the mobile table in a straight forward direction to press the chamber against the tuyere before penetration of the punch bar into the tuyere and for withdrawing the chamber after the punch bar is retracted from the tuyere.

2. A silencer as defined in claim 1, wherein said chamber consists of a front portion housing the head of the punch bar when retracted from the tuyere, and a rear portion housing said closure members.

3. A silencer as defined in claim 1, further comprising bearings secured to said puncher and a shaft slidably mounted in said bearings and having one end secured to said table and wherein said operating means is a fluid cylinder having its piston connected to the other end of said shaft for actuating said mobile table and so move said chamber into an out of engagement with the tuyere.

4. A silencer as defined in claim 3, wherein said punch bar is operated by a fluid cylinder and wherein the operation of the fluid cylinder operating the mobile table is synchronized with the operation of the fluid cylinder operating the punch bar.

5. A silencer as defined in claim 1, wherein said puncher operates a plurality of punch bars for punching plural tuyeres at the time and wherein said mobile table supports an equal number of silencer chambers.

6. A silencer as defined in claim 5, wherein the punch bars are connected to a common yoke and wherein movement of the mobile table toward the tuyere is synchronized with the movement of the punch bar but withdrawal of the mobile table is mechanically controlled by said common yoke.

7. A silencer as defined in claim 1, wherein a saddle is secured to the mobile table and supports the chamber.

8. A silencer as defined in claim 7, wherein said mobile table is provided with means for adjusting the height of said saddle so as to align the chamber vertically with respect to the axis of the tuyere.

* * * * *